US005255655A

United States Patent [19]

Denz et al.

[11] Patent Number: 5,255,655

[45] Date of Patent: Oct. 26, 1993

[54] FUEL INJECTION SYSTEM FOR AN INTERNAL COMBUSTION ENGINE

[75] Inventors: Helmut Denz, Stuttgart; Andreas Roth, Mühlacker; Ernst Wild, Oberriexingen, all of Fed. Rep. of Germany

[73] Assignee: Robert Bosch GmbH, Stuttgart, Fed. Rep. of Germany

[21] Appl. No.: 640,369

[22] PCT Filed: Jun. 15, 1989

[86] PCT No.: PCT/EP89/00673

§ 371 Date: Jan. 29, 1991

§ 102(e) Date: Jan. 29, 1991

[87] PCT Pub. No.: WO90/15921

PCT Pub. Date: Dec. 27, 1990

[51] Int. Cl.[5] ..... F02D 41/10; F02D 41/12; F02D 41/22

[52] U.S. Cl. ..... 123/479; 123/492; 123/493

[58] Field of Search ..... 123/478, 488, 492, 493

[56] References Cited

U.S. PATENT DOCUMENTS

| | | | |
|---|---|---|---|
| 4,463,732 | 8/1984 | Isobe et al. | 123/492 |
| 4,753,210 | 6/1988 | Fujimoto et al. | 123/492 |
| 4,817,572 | 4/1989 | Nakaniwa et al. | 123/492 |
| 4,924,835 | 5/1990 | Denz | 123/478 |

FOREIGN PATENT DOCUMENTS

| | | |
|---|---|---|
| 2028541 | 5/1980 | United Kingdom . |
| 2094507 | 9/1982 | United Kingdom . |

OTHER PUBLICATIONS

Patent Abstracts of Japan vol. 10, No. 234 (M-507) (2290) Aug. 14, 1986, JP-A-61 66825 (Japan Electronic Control Syst Co Ltd) Apr. 5, 1986.

Patent Abstracts of Japan vol. 7, No. 265 (M-258) (1410) Nov. 25, 1983, JP-A-58 144635 (Toyota Jidosha Kogyo K.K.) Aug. 29, 1983.

*Primary Examiner*—Tony M. Argenbright

*Attorney, Agent, or Firm*—Kenyon & Kenyon

[57] ABSTRACT

In a fuel injection system for an internal combustion engine, the system calculates the pulse width of the angle-synchronous fuel injection pulses from a main load sensor, such as an inlet manifold pressure sensor (22) or a hot film or hot wire air mass meter (24). Under rapidly-changing load conditions of the engine, the signal from the main load sensor is not sufficiently accurate to maintain a closely stoichiometric mixture. The present invention provides a throttle valve angle sensor for monitoring the degree of opening of an engine throttle (18), and changes the calculation of the basic angle-synchronous fuel injection signal when the measured rate of change of the throttle valve angle reaches a predetermined valve. The change of calculation may comprise altering filtering characteristics of a filter function normally applied to the basic angle-synchronous fuel injection signal, altering the sampling of the signal from the engine load sensor, or deriving the basic angle-synchronous fuel injection signal from the throttle valve angle signal instead of from the main load sensor signal. Furthermore, the load change compensation may be changed to a calculation from the throttle valve load signal instead of the main load signal. The system may also be arranged to inject one or more intermediate asynchronous fuel injection pulses in between the normal angle-synchronous injections, to enable the fuel/air mixture to follow a rapid change in engine load more closely.

22 Claims, 4 Drawing Sheets

FUEL INJECTION SYSTEM FOR AN INTERNAL COMBUSTION ENGINE

FIELD OF THE INVENTION

The present invention relates to a fuel injection system for an internal combustion engine.

BACKGROUND OF THE INVENTION

In an internal combustion engine having a fuel injection system, it is necessary to inject the correct amount of fuel into the engine to produce a stoichiometric fuel-/air mixture to produce satisfactory operation of the engine. In stationary conditions this is the state of the art. However, as the load on the engine increases, the amount of air drawn into each cylinder increases accordingly, and it is necessary to increase the amount of fuel injected. Conversely, as the load on the engine decreases it is necessary to reduce the amount of fuel injected. The correct matching of the air/fuel ratio even in these dynamic conditions is still a problem.

In present systems it is usual to provide a sensor in the air inlet system of the engine to give a measure of the engine load in the form of an electrical signal as a basis for calculating the amount of fuel which needs to be injected. Examples of such sensors are a pressure sensor, a hot film or hot wire air mass meter and a flap-type meter. The signals obtained from such sensors follow the load very accurately during constant load conditions and even during slowly-changing load conditions. However, under rapidly-changing load conditions, the signals obtained are inaccurate and lead to mismatching of the injected fuel. For example, the signals evaluated from a pressure sensor can only follow the true change in the load slowly with a certain delay, and thus signals obtained from it for the amount of fuel calculated therefrom to be injected produces a lean mixture. Signals from the other types of sensors mentioned overshoot considerably the value corresponding to the true load during rapidly-changing load conditions due to the fact that they measure the air drawn into the manifold which must first be filled with air, before the actual cylinder charge is increased. In some cases, after a first overshoot of the signal an undershoot occurs, especially in the case of a flap-type meter. The result is a fuel/air mixture which can excessively be rich or lean. A further reason for mismatching of the air/fuel ratio during load changes is the resulting variation of the fuel wall film which needs to be compensated for by special algorithms.

It is an object of the present invention to provide a fuel injection system for an internal combustion engine which is able to follow a rapidly-changing load more closely, and to maintain the desired air/fuel ratio.

SUMMARY OF THE INVENTION

The present invention is a fuel injection system for an internal combustion engine that calculates the pulse width of an angle-synchronous fuel injection pulses based on a main engine load sensor signal and a throttle valve angle sensor signal. The main engine load sensor signal is generated from a sensor, for example, that measures the pressure in an engine air inlet system. The throttle valve engine sensor signal is a measurement of the degree of opening of an engine throttle. The throttle valve angle sensor signal is used to change the calculation of the basic angle-synchronous fuel injection signal when the measured rate of change of the throttle valve angle is at or above a predetermined value which enables the fuel/air mixture to more closely follow any rapid change in engine load.

The present invention also changes calculation of the basic angle-synchronous fuel injection signal by altering filtering characteristic of a filter function normally applied to the basic angle-synchronous fuel injection signal, by altering sampling of the signal from the main engine load sensor, or by deriving the basic angle-synchronous fuel injection signal from the throttle valve angle signal instead of from the main load sensor signal. In addition, the system of the present invention discloses injecting one or more intermediate synchronous fuel injection pulses between the normal angle-synchronous fuel injection pulses to further enable the fuel/air mixture to more closely follow a rapid change in engine load. The present invention will be discussed in greater detail in the remainder of the specification and referring to the accompanying drawings.

BRIEF DESCRIPTION OF THE DRAWINGS

The present invention will now be described, with reference to the accompanying drawings, in which.

DETAILED DESCRIPTION OF THE INVENTION

Figure 1:
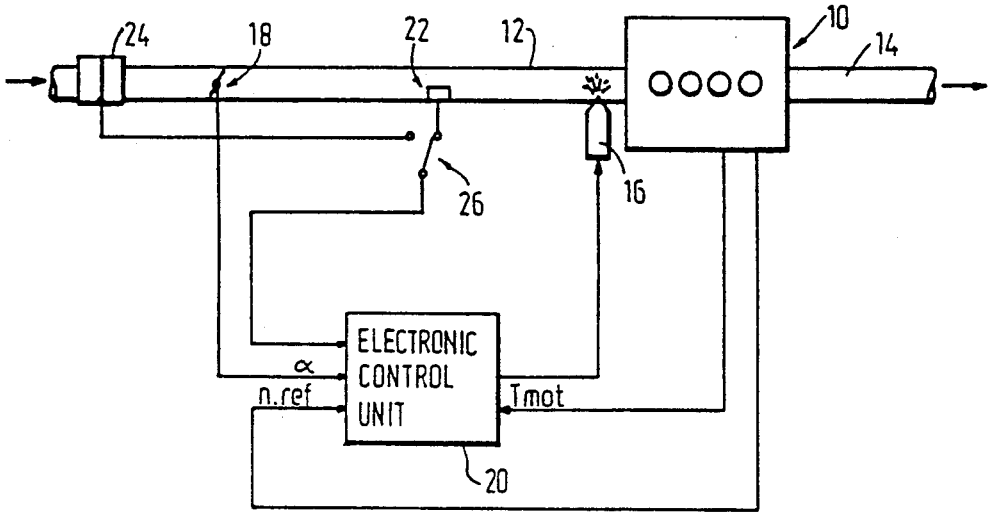
FIG. 1 is a schematic view of the control of a fuel-injected four-cylinder petrol engine, wherein the petrol injection is governed in accordance with the present invention.

Referring firstly to FIG. 1, a fuel injected four-cylinder engine 10 is provided with an inlet manifold 12 and an exhaust manifold 14. Air is sucked into the inlet manifold 12 as a result of vacuum in the engine cylinders, and a metered amount of fuel is injected into the air from one or several fuel injectors 16. The flow of air into the engine is dictated by means of a throttle valve (usually in the form of a butterfly valve) 18, which is linked to the driver's accelerator pedal. As more air is drawn into the engine, it is necessary to adjust the amount of fuel injected accordingly. The calculation of the fuel to be injected is achieved by means of an electronic control unit 20.

In order to form a stoichiometric air/fuel mixture, it is necessary to match correctly the amount of fuel injected to the amount of air drawn in. This produces cleaner and more efficient combustion of the fuel.

A measure of the amount of air passing into the engine is normally given by a main load sensor located in the air inlet system. In the embodiment of the present invention illustrated, a pressure sensor 22 and a hot-wire meter 24 are illustrated, these being alternatively connectible to the electronic control unit which is represented by a switch 26. It should be noted that, normally, only one main load sensor will be used, but two main load sensors are demonstrated in the present embodiment, to make it clear that any type of main load sensor can be used. Indeed, the type of main load sensor which may be used is not restricted to those described above, but may, for example, comprise a flap-type air flow or hot-film air-mass meter.

An electrical signal corresponding to the angular displacement $\alpha$ of the throttle valve, is also fed into the electronic control unit 20. A lead from the engine 10 supplies a signal corresponding to the rotational speed n of the engine, and also supplies reference signals corresponding to different angular positions in the 720° cycle of the engine.

Figures 2, 5:
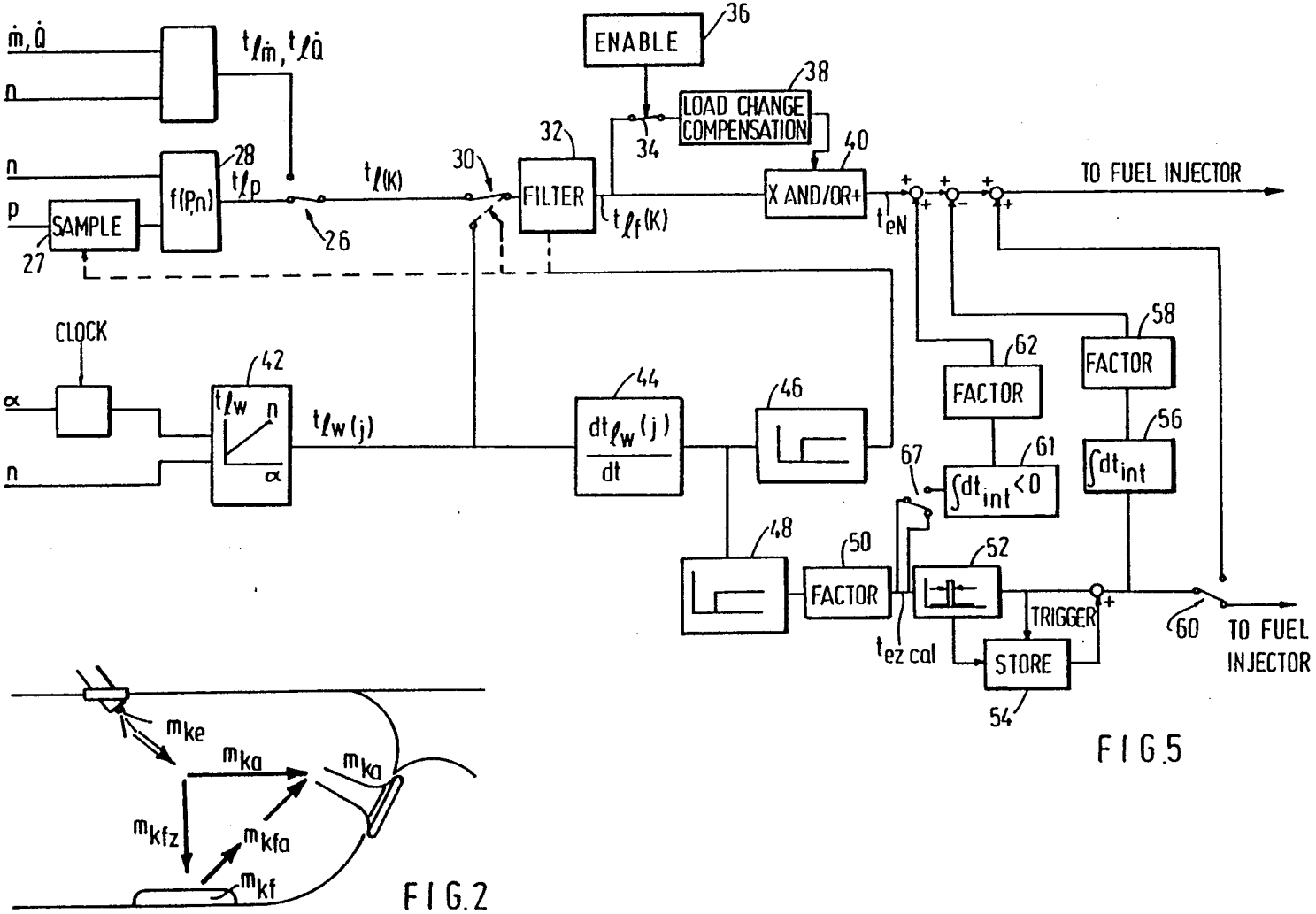
FIG. 2 is a schematic representation of the so-called wall film effect.
FIG. 5 is a schematic diagram of the operation of one embodiment of the present invention.

The upper portion of FIG. 5 shows how the normal, angle-synchronous fuel injection pulses are calculated in the control unit 20. This involves sampling at stage 27 of the pressure signal from the pressure main load sensor 22 by the electronic control unit 20 at each reference mark $t_R$ of the engine, and also at a position intermediate two adjacent reference marks $t_R$. Thus, the pressure is taken to be the average of the two values, as follows:

$$P_{tR} = \frac{(t_{R-\frac{1}{2}segment}) + P(t_R)}{2} \quad (1)$$

It should be noted that other pressure sensing methods, for example a high-speed 1 ms sampling of the pressure signal through one or several segments of 720°/number of cylinders, are also possible.

A basic angle-synchronous fuel injection pulse width $t_{lp}$ shown in FIG. 4*d* is then obtained at stage 28 by mapping the pressure value thus obtained with the signal corresponding to the engine speed n. (Similarly, if another type of sensor is used as the main load sensor, a corresponding basic angle-synchronous fuel injection pulse width $t_{l\dot{M}}$ or $t_{l\dot{Q}}$ is obtained.) The basic fuel injection pulse width thus obtained from the main load sensor will henceforth be referred to as $t_l(k)$. The basic fuel injection period $t_l(k)$ is then filtered at a filter 32 (to which it is connectible by a switch 30) in order to remove any jitter in the signal, to produce a filtered basic angle-synchronous injection pulse width $t_{lf}(k)$. The filtered signal is fed via an enabling gate 34, controlled by an enable function 36, to a load change compensation stage 38. The load change compensation stage 38 is used to alter the basic signal in a multiplicative or additive way in order to compensate for various engine parameters, one of which being the wall film model illustrated in FIG. 2.

The enable function 36 is adapted to allow load change compensation at stage 38 only when it is determined that the load change in a particular cylinder as calculated over two cycles is above a certain threshold. For example, the pressure difference associated with a particular cylinder calculated over consecutive cycles may be used, thus:

Enable function operative for P(K)—P(K—Z)>threshold, where Z=number of cylinders in the engine.

The enable function helps to ensure that load change compensation is effected only when it is required. It ensures that if cylinder-specific differences are the cause of the apparent load change, no load change compensation is effected.

In FIG. 2, when a quantity of fuel $m_{KE}$ is injected into the inlet manifold of the engine, only one part $m_K\alpha$ is directed into the cylinder, the other portion $m_{KFZ}$ being initially deposited as a film of fuel on the wall of the intake manifold. As well as fuel being deposited on the wall, fuel is also sucked-off the wall film and into the engine cylinder. There is thus a quantity $m_{KF}$ of fuel on the wall of which a proportion $m_{KFA}$ is sucked-off the wall and into the cylinder. Thus, the total amount of fuel $m_{KA}$ entering the engine cylinder is composed of a directly-injected portion $m_K\alpha$ and a wall film reduction portion $m_{KFA}$. The proportion of fuel deposited on and vaporised from, the wall film is dependent largely on the pressure and the temperature of the air in the inlet manifold.

The method, apparatus and algorithms for compensation of these wall film effects are well known to those skilled in the art, and thus the multiplicative and/or additive load change compensation has been illustrated as a single stage 38, and will not be further described in detail hereinafter. However, it is noted that the load change compensation strategy may be calculated from either the main load signal or the throttle valve load signal, or from the latter only in the case when the switch 30 has been changed.

The multiplicative and/or additive load change compensation is multiplied with or added to (as appropriate) the basic signal $t_{lf}(k)$ at stage 40, to from the adjusted normal angle-synchronous fuel injection pulse periods $t_{eN}$. The fuel injection described up to here is purely conventional, except for the aforementioned cylinder-specific enable function 36.

Figure 6:
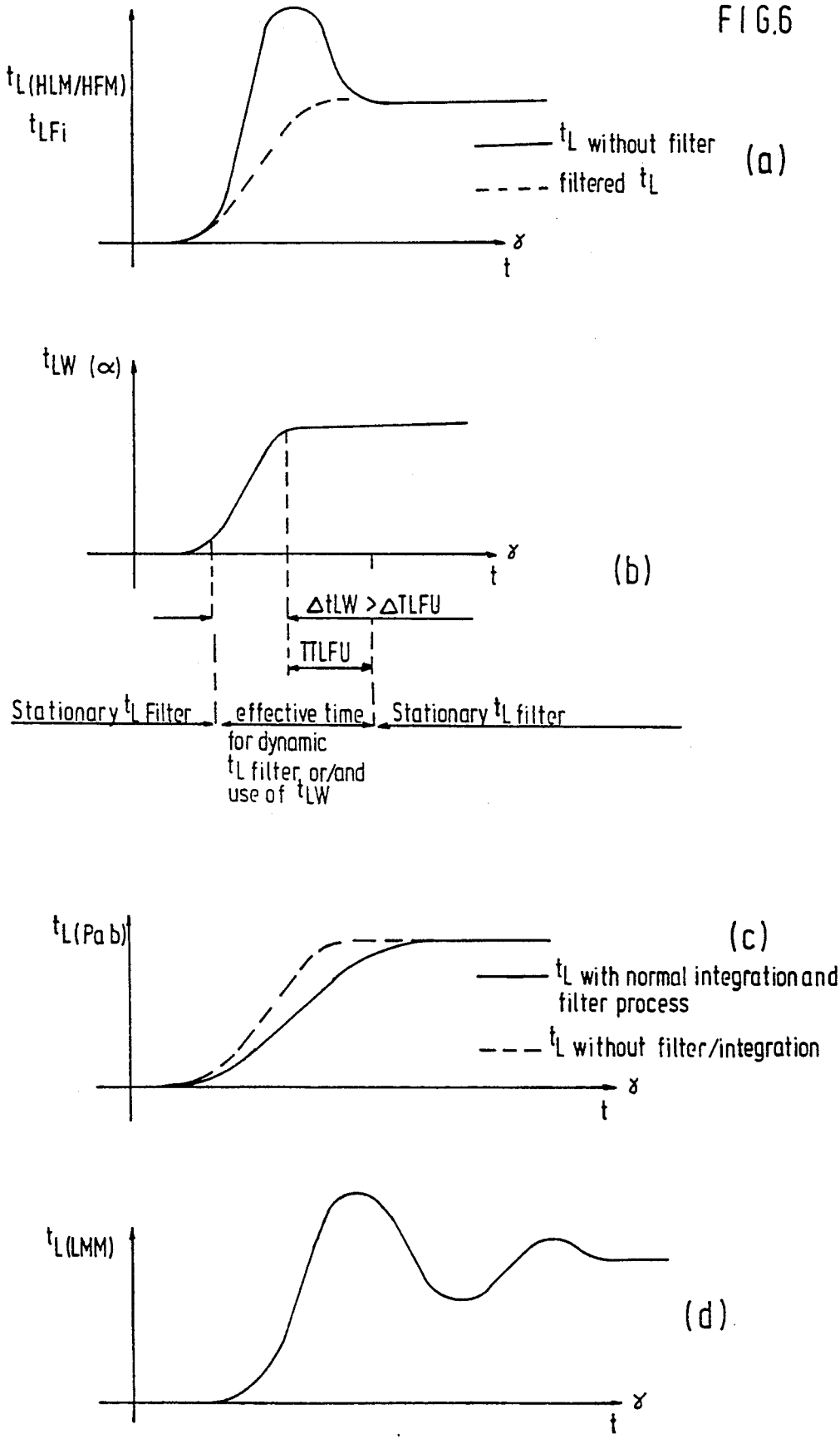
FIGS. 6(*a–d*) show a time diagram of load signals obtained with different processing methods.

The above method of fuel injection works very well in the steady state, when the load is constant, or when the load is only slowly changing, either up or down. Under these conditions, the pressure sensor (or other main load sensor) is very accurate, and provides a correctly-metered quantity of fuel. However, under larger changes of load ("dynamic" conditions) the signals from the main load sensors are not particularly suitable. In particular, the evaluated pressure sensor signal cannot follow the change in a rapidly-increasing load quickly enough, resulting in a weak mixture. On the other hand, for a rapidly-decreasing load, the mixture is too rich. Other types of main load sensor have the disadvantage that under a rapidly-changing load, the signals evaluated from these sensors overshoot considerably the correct value (hot-wire type sensors) or oscillate about the correct value (flap-type sensors), thus producing an alternately rich and lean mixture for the engine. This behaviour is shown in FIGS. 6(*a*), (*c*) and (*d*).

In the present invention, this is overcome by also detecting the angular position of the throttle valve 18, as described previously. The throttle valve is normally connected to a potentiometer in order to detect full load position of the valve, and although it has been proposed that the angular position of the throttle valve be used as a measure of the engine load, this is impractical since, under steady or slowly-changing loads, the signal is insufficiently accurate (is using a simple potentiometer), leading to non-stoichiometric mixtures. However, in fast dynamic conditions, the load signal calculated from the throttle valve opening is much more convenient than the other lead signals (as shown in FIG. 6(*b*)).

Figure 4:
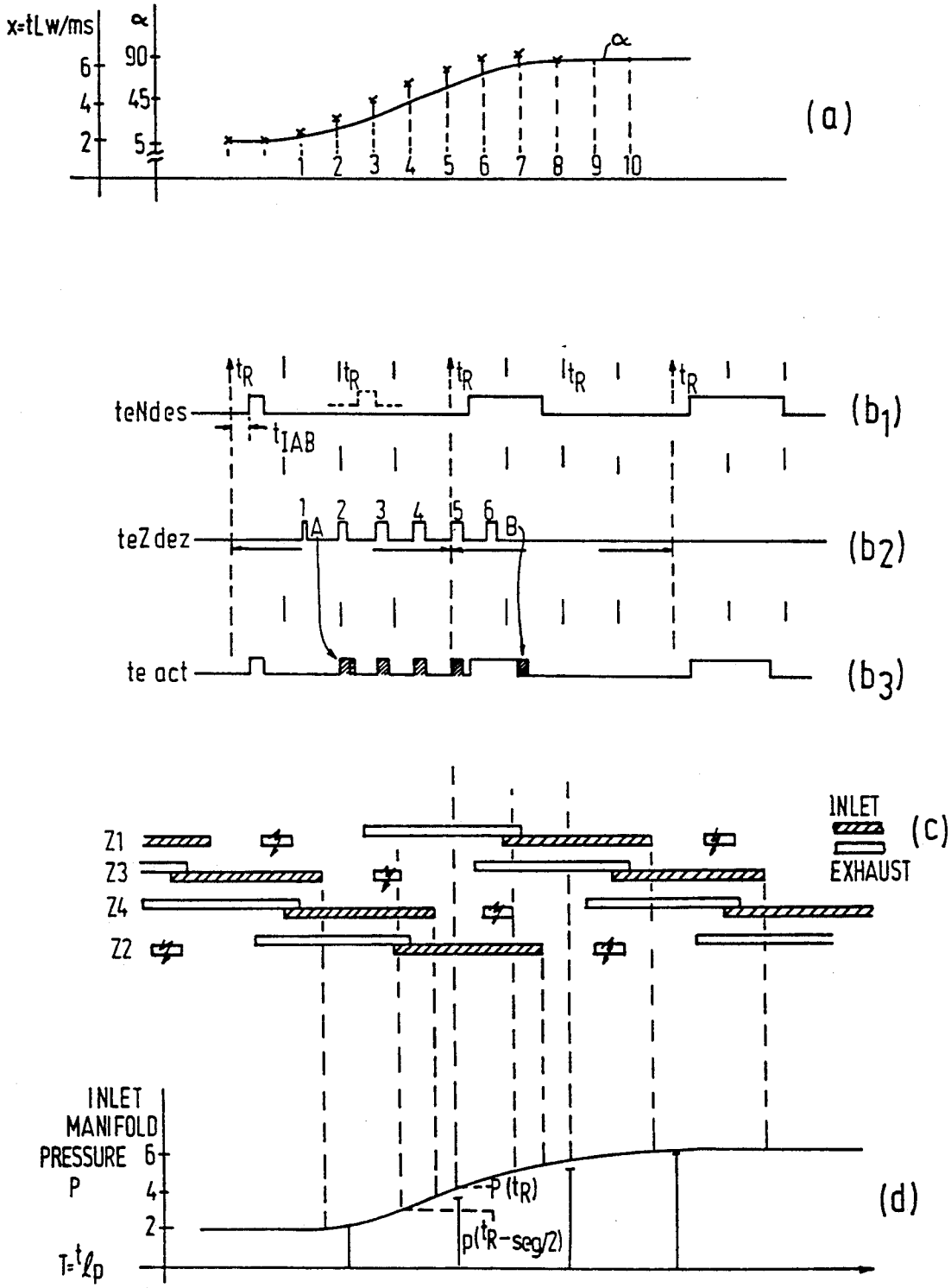
FIGS. 4*a* to 4*d* show the relationship between the throttle valve (FIG. 4*a*), the calculated and actually output fuel injection pulses (FIGS. 4($b_1$–$b_3$), the working cycles of the cylinders in the engine (FIG. 4*c*) and the inlet manifold pressure (FIG. 4*d*) during a change in load of the engine.

FIG. 4 shows the relationships between various engine parameters under a strong increasing load change. It will be noted from FIG. 4*d* that the difference in pressures as described above follows the change only slowly during the rapid load change, whereas the throttle valve angle signal $\alpha$, and in particular the signal $t_{LW}$ derived therefrom, follows the change in load much more quickly or even precedes it correctly. A similar, but inverted, situation occurs during a rapid decrease in load.

Figure 3:
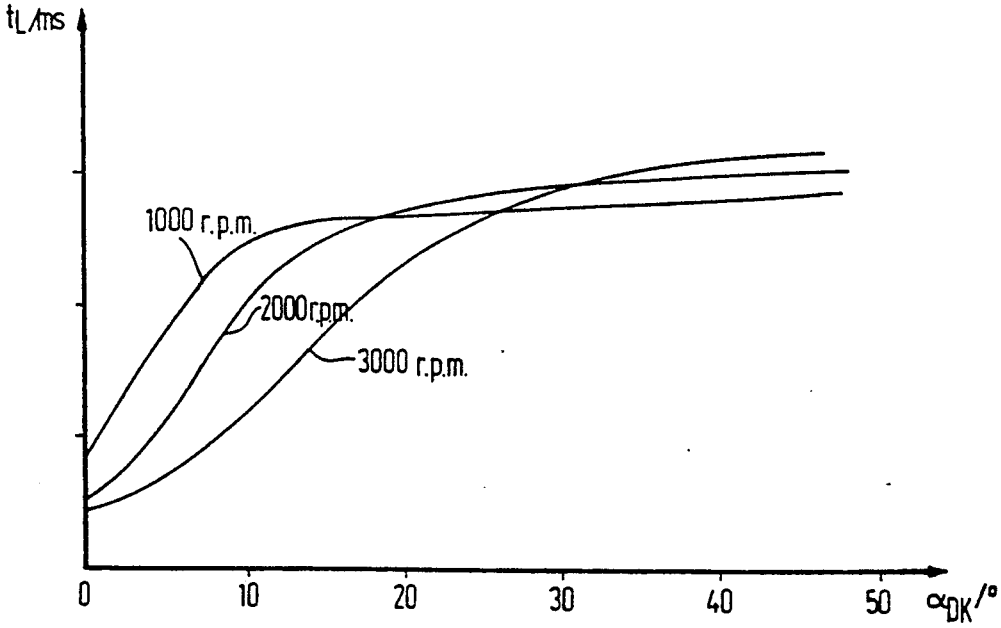
FIG. 3 is a graph showing the relationship between the throttle valve angle opening $\alpha_{DK}$ and the corresponding basic injection pulse width $t_I$ for various values of engine speed.

Referring again to FIG. 5, the signal corresponding to the throttle valve angle $\alpha$ is sampled at regular intervals (for example every 10 ms in accordance with a CLOCK signal) and, together with an input from the engine relating to the engine speed n, is mapped at stage 42 to provide its own basic, angle-synchronous fuel injection period $t_{lw}(j)$. This is shown in FIG. 3, where the output signal $t_{lw}(j)$ may be found for each value $\alpha$ of the throttle valve angle. Only three engine speeds have been given, but obviously the $t_{lw}(j)/\alpha$ relationship for many other engine speeds is stored and intermediate values are interpolated. The rate of change of this quantity is determined at stage 44, and at stage 46 it is decided whether the rate of change exceeds a predetermined threshold.

In the event of exceeding the said threshold, three procedures can be used, which may be decided by appropriate programming of the electronic control unit:

1. The switch 30 can be connected to the other contact, thereby connecting the output of stage 42 to the filter 32. In addition, the parameters of filter 32 may also be altered (although this is not essential) to reduce or remove any damping effect of the filter, since during strong acceleration or deceleration it is more important that as up-to-date a signal as possible is used to determine the normal angle-synchronous fuel injection quantity, or, for example, to smooth the change from one signal to the other in case they are not completely of the same value, a special filter value can be selected. It will be noted from FIGS. 4 and 6 that the throttle valve load signal precedes the actual change in load of the engine, and thus may be preferred during large changes in the engine load, since the signal $t_{lw}(j)$ gained from the throttle valve angle will be more accurate than the signal $t_l(k)$ from the main load sensor and due to its preceding signal characteristic may compensate for a time lag in signal processing. The signal $t_{lw}(j)$ is then treated in the same way as the previously used signal $t_l(k)$, with the exception that it is also possible to alter or remove the filtering function at stage 32.

2. The second possibility is that the switch 30 is maintained in its normal position, but the sampling operation of the pressure in the pressure sensor is altered, and/or the parameters of the filtering function 32 may be reduced or removed, as described for the first option. It will be noted that the steady state pressure signal uses a value which is half a segment out of date. In slowly changing loads or steady state conditions, this is of no consequence, but in rapidly changing load conditions it leads to a lean mixture. Thus, the sampling is altered so that the measurement of the pressure is taken to be the value of the pressure at the most recent reference mark $t_R$, and no averaging calculation is carried out. This allows a better following of the pressure signal, and the load signal calculated therefrom, to the actual engine load during rapid load changes, resulting in less air/fuel deviation.

3. The third option is that the switch 30 is maintained in its normal position, and, especially in the case of a hot wire air flow meter, the sampling is maintained as normal or may be changed, but that the filtering parameters 32 are altered to relatively high values to provide a load signal that does not follow an overshoot of the hot wire air flow meter signal due to the filling of the manifold, but that follows the manifold pressure very closely, which is shown in FIG. 6*a* in the dotted line. This characteristic can be obtained by a simple low pass filter of the first order.

The first above-mentioned method of altering the signals from the main load sensor on the basis of monitoring of the throttle valve angle signal allows a much more up-to-date angle-synchronous fuel injection signal, especially for a flap-type air flow meter or a very slow pressure signal. The second and third above-mentioned methods are preferable for turbo-charged engines or with a bypass idle speed control system, where the signal $t_{LW}$ is not necessarily equal to the load of the engine. In all three cases, the changed strategy would remain active during a time period TTLFU after the difference $\Delta t_{LW}$ has stopped being bigger than the threshold $\Delta$TLFU, as shown in FIG. 6*b*.

In addition to the three above options, it is also determined at stage 48 whether the rate of change of the injection time calculated according to the throttle valve angle signal reaches a second threshold (which may be less than, equal to, or greater than, the threshold at stage 46). If the said second threshold is exceeded, it indicates that the engine is undergoing a rapid increase in load, and the electronic control unit decides to inject further, asynchronous injection pulses in order to enrich the mixture. The threshold is normally chosen to be at a level where normal angle-synchronous injection cannot enrich the cylinders sufficiently well. For example, referring to FIG. 4*b*, it will be seen that as the load increases, the normal, angle-synchronous injection pulses increase in length, but this increase cannot prevent leaning out of the mixture in cylinder 4, and can only partially prevent leaning out in cylinder 2. Thus, intermediate, asynchronous injections are effected to prevent the leaning-out. These may be injected at several intervals during each segment, for example at 10 ms intervals. The injection in a plurality of asynchronous injections means that it is possible in all cases to inject fuel into an intake valve which is still just open. It would be unsuitable to inject the entire intermediate injection quantity at once, otherwise certain cylinders might be over-enriched, for example cylinder 4, which requires a relatively small increase in charge only.

The amount to be injected is calculated in accordance with a factor at stage 50, which might, for example, be dependent on the temperature of the engine, an adaptive correction deduced from the closed loop a/f control, or other factors. The resultant signal is a basic asynchronous injection time $t_{ezcal}$. At stage 52, if it is found that the pulse width of the asynchronous pulse calculated is below a certain threshold value, then that intermediate injection is suppressed, since the injection must be of a minimum value to take into account the opening and closing times of the fuel injector. If it is greater than the threshold, then the signal proceeds, but if it is less than the threshold it is stored in store 54, and added to the pulse width of the following asynchronous intermediate injection. This is illustrated at A in FIGS. 4*b*2 and 4*b*3.

In order to ensure that, following asynchronous intermediate injections, the normal angle-synchronous fuel injection will not over-enrich the engine, the length of all the intermediate injection pulses in each segment is summed at stage 56, and a portion of this, or all of it, as determined at stage 58, is subtracted from the following normal, angle-synchronous fuel injection pulse period.

The asynchronous injection pulses themselves open the fuel injector, unless they would be output simultaneously with a normal, angle-synchronous injection, as illustrated at point B in FIG. 4b2. In this case, the control unit 20 actuates a switch 60 to disconnect the fuel injector from the asynchronous pulse generating portion of the circuit, and this portion is instead connected to the normal, angle-synchronous portion, with the result that the calculated period of the said asynchronous intermediate injection is added to the calculated normal, angle-synchronous period.

Thus, if the electronic control system decides that the compensation effected by way of the normal, angle-synchronous injection pulses is not sufficient, then one or more intermediate, asynchronous injection pulses may also be output in each segment, thus providing rapid enrichment of the mixture, and allowing the mixture to follow the load requirement more closely and thus be more closely stoichiometric.

Clearly, the additional asynchronous pulses will normally need to be used only during rapid increases in load, and not during rapid decreases in load. In order to use the preceding characteristic of the $t_{LW}$ signal in deceleration which is decided through switch 67, negative intermediate injection pulse widths are added in a store 61, corrected through a factor 62, and the resulting negative injection time is added to the next synchronous injection pulse, thus reducing the pulse width.

It is possible to introduce a filter at the entry of stage 48 to reduce any signal jitter and even to provide a slowly-decaying effect after triggering a $\Delta$. $t_{LW}$ difference, so that intermediate injections do not only occur in the moment a $\Delta$ $t_{LW}$ occurs, but also in the sampling instances thereafter, with a diminishing pulse width. This has been omitted from FIG. 5 for simplification.

The present algorithm has been described for a simultaneous injection system. It would be easy for someone skilled in the art to adapt it to a sequential or group injection system. In case of defect of either the main load sensor or the throttle angle sensor, the system can be switched over to function with the remaining sensor.

It should be remembered that the signals obtained from the normal angle-synchronous portion of the circuit and those relating to the intermediate asynchronous injections may also have further functions carried out on them. However, the treatment of an injection pulse signal, once calculated, is common to those skilled in the art, and does not form part of the present invention.

We claim:

1. A fuel injection system for an internal combustion engine, the system comprising:

(a) main engine load sensor, with the main engine load sensor producing a first signal;

(b) means for calculating a basic angle-synchronous fuel injection pulse width, $t_l(k)$, from signals received from the main engine load sensor;

(c) throttle valve angle sensor for monitoring the degree of opening ($\alpha$) of an engine throttle valve, with the throttle valve angle sensor producing a second signal;

(d) engine speed sensor for monitoring the speed on the engine, with the engine speed sensor producing a third signal;

(e) means for calculating a fourth signal from the second and third signals, the fourth signal being a second angle-synchronous fuel pulse width $t_{lw}(j)$; and (f) means for changing the calculation of the basic fuel injection pulse width made by the means at (b) when the rate of change of the fourth signal is at or above a first predetermined value.

2. The fuel injection system as recited in claim 1, wherein the change in calculation further includes altering filtering characteristics of a filter function normally applied to the basic angle-synchronous fuel injection pulse width.

3. The fuel injection system as recited in claim 1 or 2, wherein the change in calculation further includes altering the sampling of the first signal from the main engine load sensor.

4. The fuel injection system as recited in claim 1 or 2, wherein the change in calculation further includes replacing the basic angle-synchronous fuel injection pulse width $t_l(k)$ with the second angle-synchronous fuel pulse width $t_{lw}(j)$ when predetermined conditions exist.

5. The fuel injection system as recited in claim 4, wherein the calculation of the basic angle-synchronous pulse width is changed from $t_L$ to $t_{LW}$ when the rate of change of the second angle-synchronous fuel injection pulse width $t_{lw}(j)$ is at or above a first predetermined value.

6. The fuel injection system as recited in claim 1, wherein the system is adapted to initiate at least one intermediate fuel-injection pulse between angle-synchronous pulses when the rate of change of the fourth signal is at or above a second predetermined value.

7. The fuel injection system as recited in claim 6, wherein negative correction fuel injection pulse widths are generated for a negative rate of change of the second angle-synchronous fuel pulse width $t_{lw}(j)$ to correct the basic angle-synchronous fuel injection pulse widths when there is a rapid load reduction.

8. The fuel injection system as recited in claim 7, wherein negative asynchronous pulse widths and a previous angle-synchronous fuel injection pulse width are summed, and the sum is subtracted from the next angle-synchronous fuel injection pulse width.

9. The fuel injection system as recited in claim 6, wherein if the calculated pulse width of an intermediate fuel injection pulse is less than a third predetermined value, the intermediate fuel injection pulse is suppressed, and the pulse width of the suppressed intermediate fuel injection pulse is added to the pulse width of the next intermediate fuel injection pulse.

10. The fuel injection system as recited in claim 6, wherein if an intermediate fuel injection pulse is to be output at the same time as an angle-synchronous fuel injection pulse, the intermediate pulse fuel injection is suppressed and the pulse width of the suppressed intermediate fuel injection pulse is added to the pulse width of the angle-synchronous fuel injection pulse.

11. The fuel injection system as recited in claim 6, wherein the pulse width of an angle-synchronous fuel injection pulse is reduced by an amount equal to a total length of the pulse width of intermediate fuel injection pulses following the previous angle-synchronous fuel injection pulse.

12. The fuel injection system as recited in claim 1, wherein if the main load sensor or the throttle valve angle sensor is defective, the system operates using, the remaining non-defective sensor.

13. The fuel injection system as recited in claim 7, wherein negative asynchronous pulse widths and a previous angle-synchronous fuel injection pulse width are summed, and a predetermined proportion thereof is subtracted from the next angle-synchronous fuel injection pulse width.

14. The fuel injection system as recited in claim 6, wherein the pulse width of an angle-synchronous fuel injection pulse is reduced by an amount equal to a predetermined portion of a total length of the pulse width of intermediate fuel injection pulses following the previous angle-synchronous fuel injection pulse.

15. A fuel injection system for an internal combustion engine, the system comprising:

(a) main engine load sensor, with the main engine load sensor producing a first signal;

(b) means for calculating a basic angle-synchronous fuel injection pulse width, $t_l(k)$, from signals received from the main engine load sensor;

(c) throttle valve angle sensor for monitoring the degree of opening ($\alpha$) of an engine throttle valve, with the throttle valve angle sensor producing a second signal;

(d) means for calculating an alternative basic fuel injection fuel injection pulse width signal $t_{lw}(j)$ using the second signal; and (e) means for changing the calculation of the basic angle-synchronous fuel injection pulse width made by the means at (b) from $t_L$ to $t_{LW}$ when the rate of change of the alternative basic fuel injection fuel injection pulse width signal $t_{lw}(j)$ is at or above a first predetermined value.

16. A fuel injection system for an internal combustion engine, the system comprising:

(a) main engine load sensor, with the main engine load sensor producing a first signal;

(b) means for calculating a basic angle-synchronous fuel injection pulse width, $t_l(k)$, from signals received from the main engine load sensor;

(c) throttle valve angle sensor for monitoring the degree of opening ($\alpha$) of an engine throttle valve, with the throttle valve angle sensor producing a second signal;

(d) means for calculating an alternative basic fuel injection fuel injection pulse width signal $t_{lw}(j)$ using the second signal;

(e) means for changing the calculation of the basic angle-synchronous fuel injection pulse width made by the means at (b) from $t_L$ to $t_{LW}$ when the rate of change of the alternative basic fuel injection fuel injection pulse width signal $t_{lw}(j)$ is at or above a first predetermined value (f) means for altering filtering characteristics of a filter function applied to the basic angle-synchronous fuel injection pulse width.

17. A fuel injection system for an internal combustion engine, the system comprising:

(a) main engine load sensor, with the main engine load sensor producing a first signal;

(b) means for calculating a basic angle-synchronous fuel injection pulse width, $t_l(k)$, from signals received from the main engine load sensor;

(c) throttle valve angle sensor for monitoring the degree of opening ($\alpha$) of an engine throttle valve, with the throttle valve angle sensor producing a second signal;

(d) means for changing the calculation of the fuel injection pulse width made by the means at (b) when the rate of change of the second signal from the throttle valve angle sensor is at or above a first predetermined value;

(e) means for adapting the system to initiate at least one intermediate fuel-injection pulse between angle-synchronous pulses, when the rate of change of the second signal is at or above a second predetermined value; and (f) means for generating negative correction asynchronous fuel injection pulse widths for negative rates of change of the second signal to correct the angle-synchronous fuel injection pulse widths when there is a rapid load reduction.

18. The fuel injection system as recited in claim 17, wherein negative asynchronous fuel injection pulse widths and a previous angle-synchronous fuel injection pulse width are summed, and the sum is subtracted from the next angle-synchronous fuel injection pulse width.

19. The fuel injection system as recited in claim 17, wherein negative asynchronous fuel injection pulse widths and a previous angle-synchronous fuel injection pulse width are summed, and a predetermined proportion thereof is subtracted from the next angle-synchronous fuel injection pulse width.

20. A fuel injection system for an internal combustion engine, the system comprising:

(a) main engine load sensor, with the main engine load sensor producing a first signal;

(b) means for calculating a basic angle-synchronous fuel injection pulse width, $t_l(k)$, from signals received from the main engine load sensor;

(c) throttle valve angle sensor for monitoring the degree of opening ($\alpha$) of an engine throttle valve, with the throttle valve angle sensor producing a second signal;

(d) means for changing the calculation of the fuel injection pulse width made by the means at (b) when the rate of change of the second signal from the throttle valve angle sensor is at or above a first predetermined value; and (e) means for generating negative correction asynchronous fuel injection pulse widths for negative rates of change of the second signal to correct the angle-synchronous fuel injection pulse widths when there is a rapid load reduction.

21. The fuel injection system as recited in claim 20, wherein negative asynchronous fuel injection pulse widths and a previous angle-synchronous fuel injection pulse width are summed, and the sum is subtracted from the next angle-synchronous fuel injection pulse width.

22. The fuel injection system as recited in claim 20, wherein negative asynchronous fuel injection pulse widths and a previous angle-synchronous fuel injection pulse width are summed, and a predetermined proportion thereof is substracted from the next angle-synchronous fuel injection pulse width.

* * * * *